US011300904B2

(12) United States Patent
Kawai et al.

(10) Patent No.: US 11,300,904 B2
(45) Date of Patent: Apr. 12, 2022

(54) FIXING APPARATUS

(71) Applicant: Canon Kabushiki Kaisha, Tokyo (JP)

(72) Inventors: Hiroki Kawai, Chiba (JP); Mitsuru Hasegawa, Ibaraki (JP); Ayano Ogata, Ibaraki (JP); Yasuharu Toratani, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/330,619

(22) Filed: May 26, 2021

(65) Prior Publication Data

US 2021/0373468 A1 Dec. 2, 2021

(30) Foreign Application Priority Data

May 28, 2020 (JP) ..... JP2020-093137

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2042
See application file for complete search history.

(56) References Cited

U.S. PATENT DOCUMENTS 4,618,240 A * 10/1986 Sakurai ..... G03G 15/2053 219/216
7,187,899 B2 * 3/2007 Cao ..... G03G 15/2017 399/328
2005/0280682 A1 * 12/2005 Kato ..... B41J 11/0024 347/102
2009/0052927 A1 2/2009 Yoshikawa
2009/0274477 A1 * 11/2009 Okamoto ..... G03G 15/2064 399/69
2016/0273832 A1 * 9/2016 Asada ..... F26B 3/20
2017/0168433 A1 * 6/2017 Okamoto ..... G03G 15/2039
2021/0181661 A1 * 6/2021 Seki ..... G03G 15/2042

FOREIGN PATENT DOCUMENTS

JP 09185275 A 7/1997
JP 2009053228 A 3/2009
JP 2011123178 A * 6/2011 ..... G03G 15/2028
JP 2016173191 A * 9/2016 ..... F26B 3/20

* cited by examiner

*Primary Examiner* — Sevan A Aydin
(74) *Attorney, Agent, or Firm* — Venable LLP

(57) ABSTRACT

A fixing apparatus includes a heating roller including a plurality of halogen heaters whose number is three or more and a driving-force transmission member disposed on one end portion of the heating roller and configured to transmit rotational force that rotates the heating roller. The plurality of halogen heaters whose number is three or more includes at least one asymmetric halogen heater in which an amount of heat generated from one end side on which the driving-force transmission member is provided is larger than an amount of heat generated from another end side, and in which heat generation distribution is asymmetric with respect to a center of a heat generating portion in a longitudinal direction, and at least one symmetric halogen heater in which heat generation distribution is symmetric with respect to a center of a heat generating portion in a longitudinal direction, and the number of symmetric halogen heaters is larger than the number of asymmetric halogen heaters.

7 Claims, 11 Drawing Sheets

FIXING APPARATUS

BACKGROUND OF THE INVENTION

Field of the Invention

The present invention relates to a fixing apparatus that fixes a toner image borne by a recording material, to the recording material.

Description of the Related Art

Japanese Patent Application Publication No. 2009-53228 proposes a fixing apparatus in which multiple halogen heaters are disposed inside a roller. The respective light distributions of the halogen heaters are different from each other in the width direction of the roller.

By the way, there is a case in which the distribution of heat capacity of a rotary member, such as a roller, that is heated by heaters is asymmetric in the width direction. For example, if a rotation transmission portion, such as a gear, used for transmitting driving force from a driving source to the roller is disposed on one end portion of the roller in the width direction, the heat capacity of the roller becomes larger in the one end side in the width direction than in the other end side. Thus, if the distribution of heat capacity of the rotary member is asymmetric in the width direction, and if the output distribution of the heaters is symmetric in the width direction, the temperature of the one end side of the rotary member that has larger heat capacity may not rise sufficiently, causing failure of the fixing. As countermeasures, Japanese Patent Application Publication No. H09-185275 describes a configuration in which a heater (asymmetric heater) is disposed, and in the heater, one end side of the heater on which a gear is provided emits light more than the other end side does. This configuration can reduce unevenness in temperature between the gear side and the other end side of a rotary member.

By the way, there is a belt fixing apparatus in which a belt is stretched by and wound around a heating roller having three or more halogen heaters and a stretching member. In the present embodiment, the belt fixing apparatus, in which the belt is stretched by and wound around the heating roller and the stretching member, is used in a color-image forming apparatus. Since the belt and the heating roller have less heat capacity, the belt fixing apparatus has advantageously higher thermal responsivity than that of conventional fixing apparatuses having a roller pair. However, since the belt and the heating roller has less heat capacity, the temperature of a center portion of the roller easily reaches a target temperature earlier than the temperature of an end portion of the roller does. As a result, unevenness in heat capacity of the roller will be easily produced in the longitudinal direction. Thus, although the asymmetric heater is effective for the belt fixing apparatus, the end portion of the roller, on which the gear is disposed, may be overheated and the unevenness in temperature of the roller may be produced if the asymmetric heater is increased in number.

SUMMARY OF THE INVENTION

The present invention provides a fixing apparatus including three or more halogen heaters and having a configuration that allows the temperature of the gear side to rise quickly, and that can reduce the unevenness in temperature of a fixing member in the longitudinal direction.

According to one aspect of the present invention, a fixing apparatus that fixes an image to a recording material, includes an endless rotatable belt, a heating roller including a plurality of halogen heaters whose number is three or more, and configured to stretch and heat the belt, a driving-force transmission member disposed on one end portion of the heating roller and configured to transmit rotational force that rotates the heating roller, a pressing member configured to form a nip portion in cooperation with the belt, the nip portion is a portion in which a recording material is nipped and conveyed, a nip-portion forming member disposed in contact with an inner surface of the belt, the nip-portion forming member and the pressing member being configured to form the nip portion, a temperature detection member configured to detect a temperature of the heating roller or the belt, and a control unit configured to control energization of each of the halogen heaters depending on output front the temperature detection member. The plurality of halogen heaters whose number is three or more includes a halogen heater in which an amount of heat generated from one end side on which the driving-force transmission member is provided is larger than an amount of heat generated from another end side, and in which heat generation distribution is asymmetric with respect to a center of a heat generating portion in a longitudinal direction, and a halogen heater in which heat generation distribution is symmetric with respect to a center of a heat generating portion in a longitudinal direction, and the symmetric halogen heater is larger in number than the asymmetric halogen heater.

Further features of the present invention will become apparent from the following description of exemplary embodiments with reference to the attached drawings.

DESCRIPTION OF THE EMBODIMENTS

First Embodiment

Figure 1:
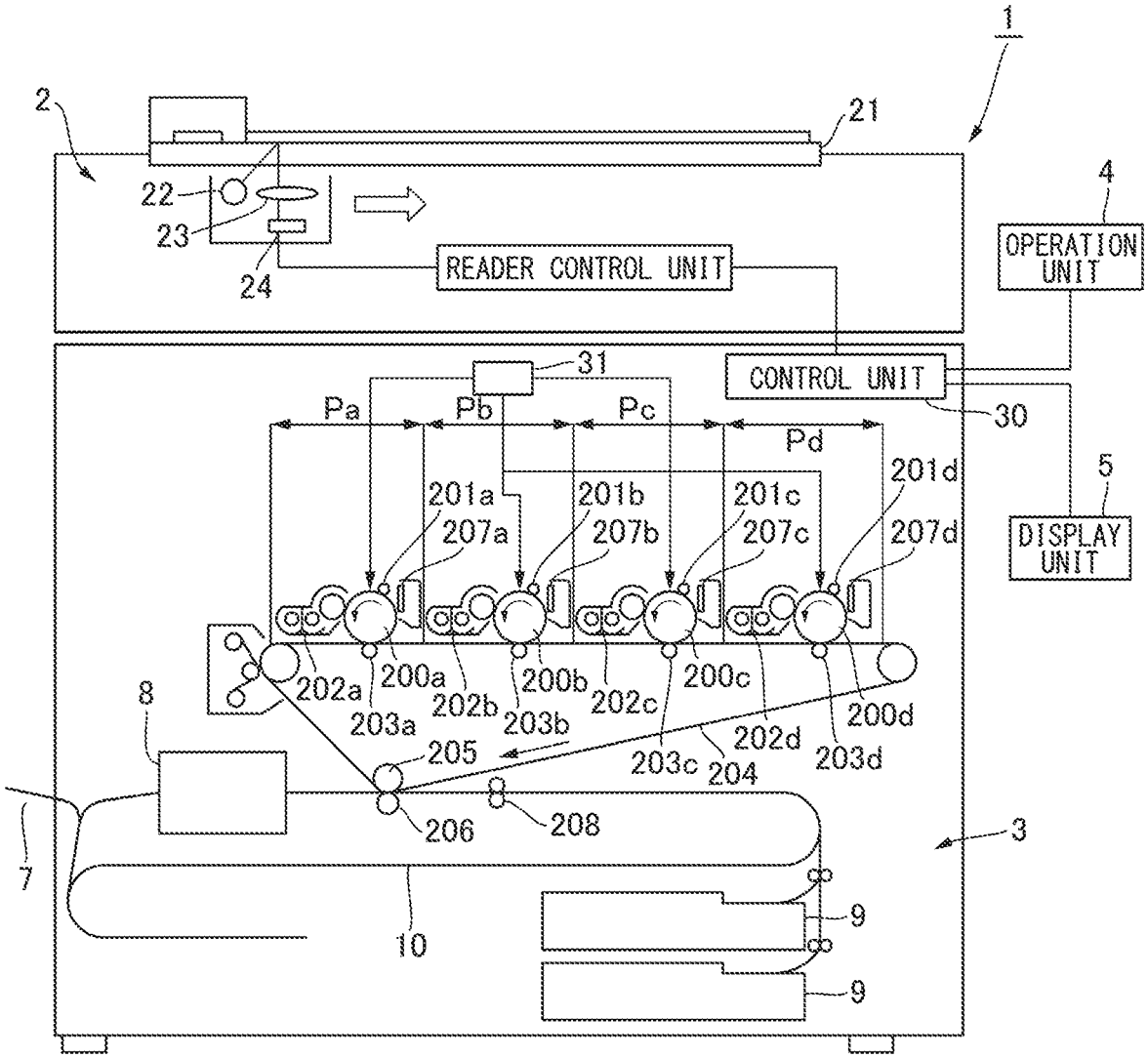
FIG. 1 is a cross-sectional view of a schematic configuration of an image firming apparatus of a first embodiment.

A first embodiment will be described with reference to FIGS. 1 to 6. First, a schematic configuration of an image forming apparatus of the present embodiment will be described with reference to FIG. 1.

Image Forming Apparatus

An image forming apparatus 1 is an electrophotographic full-color printer that includes four image forming portions Pa, Pb, Pc, and Pd, which correspond to four colors of yellow, magenta, cyan, and black. In the present embodiment, the image forming apparatus 1 is a tandem-type image forming apparatus in which the image forming portions Pa, Pb, Pc, and Pd are disposed along a rotational direction of a later-described intermediate transfer belt 204. The image forming apparatus 1 forms a toner image (image) on a recording material, in accordance with an image signal sent from an image reading unit (document reading apparatus) 2 connected to an image forming apparatus body 3, or from a host device, such as a personal computer, communicatively connected with the image forming apparatus body 3. The recording material may be a sheet material, such as a paper sheet, a plastic film, or a cloth sheet.

The image forming apparatus 1 includes the image reading unit 2 and the image forming apparatus body 3. The image reading unit 2 reads a document placed on a document platen glass 21. In the image reading unit 2, light emitted from a light source 22 is reflected from the document, and forms an image on a CCD sensor 24 via an optical member 23 such as a lens. Such an optical unit scans the document in a direction indicated by an arrow, and transforms the image of the document into electrical-signal data row for each line. The image signal obtained by the CCD sensor 24 is sent to the image forming apparatus body 3; and processed, as described later, by a control unit 30 for each image forming portion. Note that the control unit 30 also receives an image signal from an external host device, such as a print server.

The image forming apparatus body 3 includes the plurality of image forming portions Pa, Pb, Pc, and Pd, each of which forms an image in accordance with the above-described image signal. Specifically, the image signal is converted to a PWM (pulse width modulated) laser beam by the control unit 30. A polygon scanner 31 serves as an exposure apparatus, and performs scanning by using the laser beam in accordance with the image signal. Photosensitive drums 200*a* to 200*d* respectively serve as image bearing members of the image forming portions Pa to Pd, and are irradiated with the laser beam.

Note that the image forming portions Pa, Pb, Pc, and Pd respectively form images of yellow (Y), magenta (M), cyan (C), and black (Bk). Since the image forming portions Pa to Pd have substantially the same configuration, the following description will be made in detail for the image forming portion Pa of yellow Y, and the description for the other image forming portions will be omitted. As described next, in the image forming portion Pa, a toner image is formed on the surface of the photosensitive drum 200*a* in accordance with an image signal.

A charging roller 201*a* serves as a primary charger, and charges the surface of the photosensitive drum 200*a* at a predetermined potential for the formation of an electrostatic latent image. The electrostatic latent image is formed on the surface of the photosensitive drum 200*a*, which has been charged at a predetermined potential, by the laser beam from the polygon scanner 31. A development unit 202*a* develops the electrostatic latent image formed on the photosensitive drum 200*a*, and forms a toner image. A primary transfer roller 203*a* transfers the toner image formed on the photosensitive drum 200*a* onto the intermediate transfer belt 204 by discharging electricity from a back side of the intermediate transfer belt 204 and applying a primary transfer bias to the intermediate transfer belt 204. The polarity of the primary transfer bias is opposite to the polarity of the toner. After the toner image is transferred onto the intermediate transfer belt 204, the surface of the photosensitive drum 200*a* is cleaned by a cleaner 207*a*.

One toner image formed on the intermediate transfer belt 204 is conveyed to the next image forming portion, and another toner image formed by the next image forming portion and having a corresponding color is transferred onto the one toner image formed on the intermediate transfer belt 204. In this manner, toner images having respective colors are formed on the intermediate transfer belt 204 sequentially in the order of Y, M, C, and Bk, into a four-color toner image. The toner image that has passed through the image forming portion Pd, which corresponds to the color of Bk and is located most downstream in the rotational direction of the intermediate transfer belt 204, is conveyed to a secondary transfer portion formed by a secondary-transfer roller pair 205, 206. In the secondary transfer portion, a secondary-transfer electric field, whose polarity is opposite to the polarity of the toner image formed on the intermediate transfer belt 204, is applied to the toner image, and the toner image is secondary-transferred onto a recording material.

The recording material is stored in a cassette 9. The recording material is fed from the cassette 9, conveyed to a registration portion 208 formed by a pair of registration rollers, and waits at the registration portion 208. Then, the timing is controlled for aligning the position of the toner image formed on the intermediate transfer belt 204 with the position of the recording material, and the recording material is conveyed to the secondary transfer portion at the timing by the registration portion 208.

In the secondary transfer portion, the toner image is transferred onto the recording material. The recording material is then conveyed to a fixing apparatus 8. In the fixing apparatus 8, the recording material is heated and pressed, and the toner image borne by the recording material is fixed to the recording material. The recording material having passed through the fixing apparatus 8 is discharged to a discharging tray 7. In a case where images are formed on both sides of the recording material, after a toner image is transferred and fixed to a first side (front side) of the recording material, the recording material is conveyed to a reverse-and-conveyance portion 10, and reversed. Then, another toner image is transferred and fixed to a second side (back side) of the recording material, and the recording material is discharged to the discharging tray 7 and stacked on the same.

The control unit 30 controls the whole of the image forming apparatus 1, as described above. In addition, the control unit 30 can perform various types of setting in accordance with input data, which is inputted through an operation unit 4 or a display unit 5 of the image forming apparatus 1. The operation unit 4 and the display unit 5 are included in the image forming apparatus 1, and may include a touch panel and buttons. The touch panel allows a user to perform touch operation.

The control unit 30 includes a central processing unit (CPU), a read only memory (ROM), and a random access memory (RAM). The CPU reads a program stored in the ROM and corresponding to a control procedure, and controls each component. The RAM stores work data and input data. The CPU refers to the data stored in the RAM, depending on the above-described program; and controls each component.

Fixing Apparatus

Figure 2:
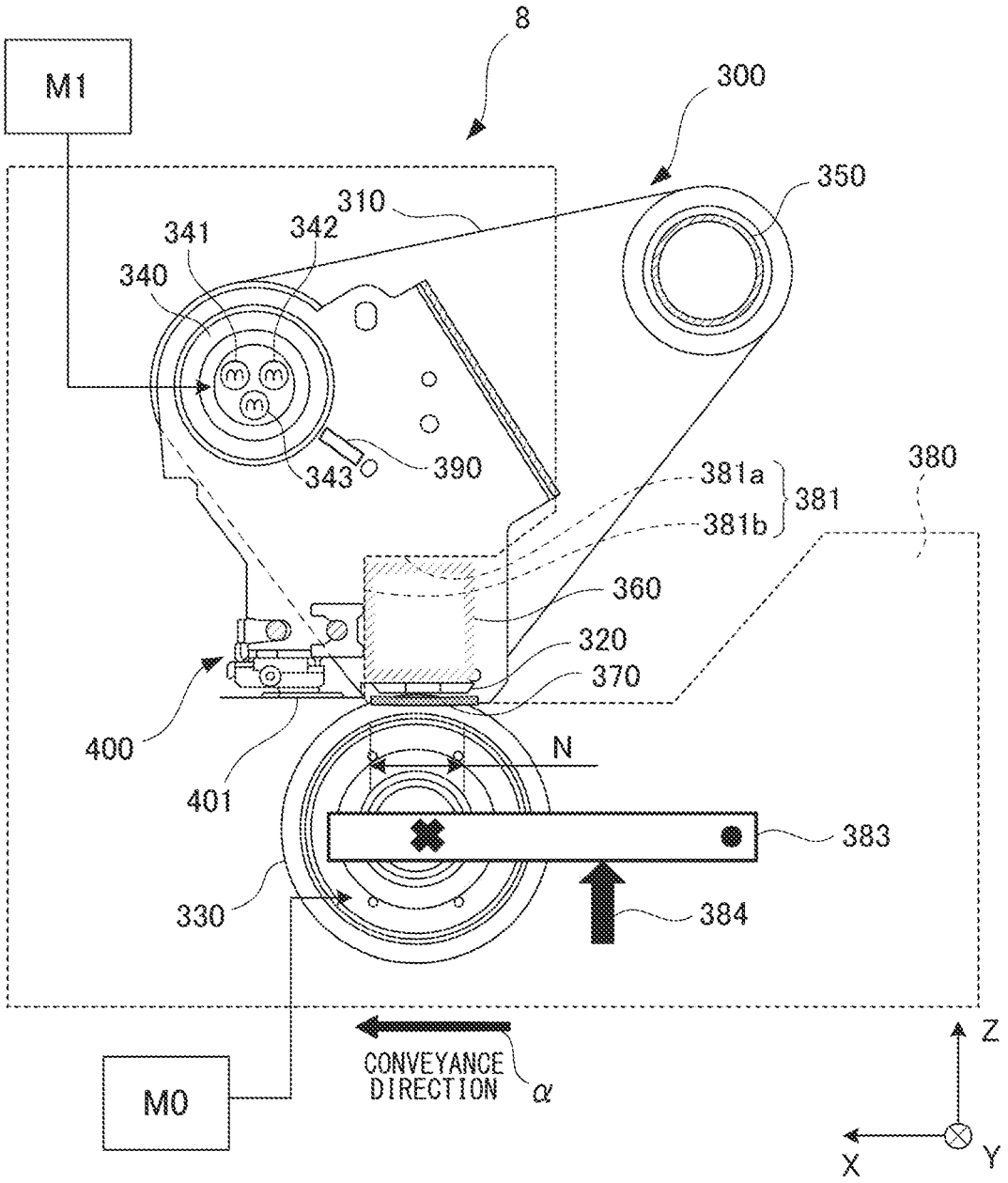
FIG. 2 is a cross-sectional view of a schematic configuration of a fixing apparatus of the first embodiment.

Next, a configuration of the fixing apparatus 8 of the present embodiment will be described with reference to FIG. 2. In the present embodiment, the fixing apparatus 8 is a belt-heating fixing apparatus that uses an endless belt. In FIG. 2, the recording material is conveyed from right to left, as indicated by an arrow α. The fixing apparatus 8 includes a heating unit 300 and a pressing roller 330. The heating unit 300 includes an endless fixing belt 310 that can rotate. The pressing roller 330 serves as a rotary pressing member, and abuts against the fixing belt 310. The pressing roller 330 and the fixing belt 310 form a nip portion N.

The heating unit 300 includes the above-described fixing belt 310, a fixing pad 320, a heating roller 340, and a steering roller 350. The fixing pad 320 serves as a nip-portion forming member and a pad member, and the heating roller 340 and the steering roller 350 serve as stretching rollers. The pressing roller 330 serves also as a driving roller that rotates in contact with the outer circumferential surface of the fixing belt 310, and that provides driving force to the fixing belt 310.

The endless fixing belt 310 has thermal conductivity and thermal resistance, and is formed like a hollow thin cylinder that has an outer diameter of 120 mm for example. In the present embodiment, the fixing belt 310 has a three-layer structure in which a base layer, an elastic layer, and a release layer are formed. The elastic layer is formed on the outer circumferential surface of the base layer, and the release layer is formed on the outer circumferential surface of the elastic layer. The base layer has a thickness of 60 μm, and is made of polyimide resin (PI). The elastic layer has a thickness of 300 μm, and is made of silicone rubber. The release layer has a thickness of 30 μm, and is made of PFA (tetrafluoroethylene-perfluoroalkoxy ethylene copolymer) that is a fluororesin. The fixing belt 310 is stretched by and wound around the fixing pad 320, the heating roller 340, and the steering roller 350.

The fixing pad 320 serves as a nip-portion forming member, and is disposed inside the fixing belt 310 so as to face the pressing roller 330 via the fixing belt 310. In addition, the fixing pad 320 forms the nip portion N in which the recording material is conveyed while nipped between the fixing belt 310 and the pressing roller 330. In the present embodiment, the fixing pad 320 is a member formed like a long plate that extends in the width direction of the fixing belt 310 (i.e., longitudinal direction that intersects the rotational direction of the fixing belt 310, or rotation-axis direction of the heating roller 340). The fixing pad 320 is pressed by the pressing roller 330 via the fixing belt 310, so that the nip portion N is formed. The material of the fixing pad 320 is a liquid crystal polymer (LCP) resin.

A portion of the fixing pad 320 forms the nip portion N, and at least one portion of the portion of the fixing pad 320 is made flat. That is, one portion of the fixing pad 320 that is in contact with the inner circumferential surface of the fixing belt 310 via a later-described lubricating sheet 370 is made nearly flat, making the nip portion nearly flat. With this configuration, especially when a toner image is fixed to an envelope that is a recording material, creases and shift in image position can be suppressed from occurring in the envelope.

The fixing pad 320 is supported by a stay 360, which is disposed inside the fixing belt 310 and serves as a support member. That is, the stay 360 is disposed opposite to the pressing roller 330 with respect to the fixing pad 320, and supports the fixing pad 320. The stay 360 is a long rigid reinforcing member that extends along the longitudinal direction of the fixing belt 310, and abuts against the fixing pad 320 and backs up the fixing pad 320. That is, when the fixing pad 320 is pressed by the pressing roller 330, the stay 360 allows the fixing pad 320 to have strength, and ensures the pressure of the pressing roller 330 applied in the nip portion N.

The stay 360 is made of metal such as stainless steel, and the cross section (transverse cross section) of the stay 360 is almost rectangular. The cross section is orthogonal to the longitudinal direction of the stay 360, which intersects the rotational direction of the fixing belt 310. For ensuring the strength of the stay 360, the stay 360 may be formed so as to have an almost hollow-square-shape transverse cross section, by using a material made of SUS304 (stainless steel), having a thickness of 3 mm, and used in drawing process. Note that the stay 360 may be formed by combining a plurality of metal plates and fixing them to each other through welding or the like such that the cross section of the stay 360 becomes almost rectangular. In addition, the material of the stay 360 may not be stainless steel as long as the strength of the stay 360 is ensured.

The lubricating sheet 370 is interposed between the fixing pad 320 and the fixing belt 310. In the present embodiment, the lubricating sheet 370 is a PI (polyimide) sheet coated with PTFE (polytetrafluoroethylene). The thickness of the lubricating sheet 370 is 100 μm. On the PI sheet, projections having a height of 100 μm are formed at intervals of 1 mm for reducing the contact area between the lubricating sheet 370 and the fixing belt 310 to reduce the slide resistance.

In addition, lubricant is applied onto the inner circumferential surface of the fixing belt 310 for allowing the fixing belt 310 to smoothly slide with respect to the fixing pad 320 covered by the lubricating sheet 370. The lubricant used is silicone oil.

As illustrated in FIG. 2, the heating roller 340 is disposed inside the fixing belt 310, and the fixing belt 310 is stretched by and wound around the heating roller 340, the fixing pad 320, and the steering roller 350. Since the inner circumferential surface of the fixing belt 310 is applied with the lubricant as described above, the heating roller 340 stretches the fixing belt 310 via the lubricant. The heating roller 340 is disposed downstream of the fixing pad 320 and upstream of the steering roller 350 in the rotational direction of the fixing belt 310. In this configuration, no stretching roller is disposed between the nip portion N and the heating roller 340, and the fixing belt 310 that has passed through the nip portion N is pulled directly by the driving force of the heating roller 340.

The heating roller 340 is made of metal such as aluminum or stainless steel, and formed like a cylinder. Inside the heating roller 340, halogen heaters 341, 342, and 343 are disposed, as heaters, for heating the fixing belt 310. Thus, the heating roller 340 is heated up to a predetermined temperature by the halogen heaters 341, 342, and 343.

In the present embodiment, the heating roller 340 is a pipe made of stainless steel and having a thickness of 2 mm. In the present embodiment, three halogen heaters 341, 342, and 343 are disposed in the heating roller 340. Note that the heaters may not be the halogen heaters, and may be other heaters, such as carbon heaters, that can heat the heating roller 340. The fixing belt 310 is heated by the heating roller 340 heated by the halogen heaters 341, 342, and 343; and is controlled, depending on a temperature detected by a thermistor 390 that serves as a temperature detection member, so as to have a predetermined target temperature in accordance with a type of the recording material. The thermistor 390 is disposed in contact with the heating roller 340.

The heating roller 340 is rotatably supported by a fixing frame 380 of the fixing apparatus 8. In addition, the heating roller 340 has a gear 345 (see FIG. 3A for example) fixed to one end portion of the heating roller 340 in the rotation-axis direction, and is coupled with a motor M1 via the gear 345. Thus, the heating roller 340 is rotated by the motor M1, which serves as a driving source. The driving force is provided to the fixing belt 310 by the rotation of the heating roller 340. The force provided from the heating roller 340 to the fixing belt 310 is assistance driving force. Note that the heating roller 340 may be coupled with a later-described motor M0 that serves as a pressing-roller driving source, and may be rotated by the motor M0. In addition, the mechanism to transmit the driving force from the motor may be another mechanism other than the gear. For example, the mechanism may be a pulley and a belt, or may be a mechanism that presses a roller driven by a motor, against the outer surface of the heating roller 340. In any configuration, in the present embodiment, the circumferential speed of the heating roller 340 is higher than the circumferential speed of the pressing roller 330.

The steering roller 350 is disposed inside the fixing belt 310, and the fixing belt 310 is stretched by and wound around the steering roller 350, the fixing pad 320, and the heating roller 340. The steering roller 350 is rotated by the rotation of the fixing belt 310. The steering roller 350 slants with respect to the rotation-axis direction (longitudinal direction) of the heating roller 340, and thereby controls the position (deviation position) of the fixing belt 310 in the rotation-axis direction. Specifically, the steering roller 350 has a pivot center positioned at the center of the steering roller 350 in the rotation-axis direction (longitudinal direction), and swings on the pivot center. In this manner, the steering roller 350 slants with respect to the longitudinal direction of the heating roller 340. Thus, the steering roller 350 produces difference in tension between one end side and the other end side of the fixing belt 310 in the longitudinal direction of the fixing belt 310, and thereby moves the fixing belt 310 in the longitudinal direction.

The fixing belt 310, while rotating, deviates toward one of its end portions, depending on the accuracy of outer diameter of the rollers that stretch the fixing belt 310 and on the accuracy of alignment between the rollers. For this reason, such deviation is controlled by the steering roller 350. Note that the steering roller 350 may be swung by a driving source such as a motor, or by self aligning. In addition, the pivot center may be positioned, as in the present embodiment, at the center of the steering roller 350 in the longitudinal direction, or may be positioned at an end portion of the steering roller 350 in the longitudinal direction.

In addition, in the present embodiment, the steering roller 350 serves also as a tension roller that is urged by a spring, which is supported by a frame of the heating unit 300, and that provides predetermined tension to the fixing belt 310. Note that another roller that does not have such a steering function may be disposed at the position of the steering roller 350, instead of the steering roller 350. For example, the other roller may be a tension roller that provides tension to the fixing belt 310, or may be a stretching roller that merely stretches the fixing belt 310.

The pressing roller 330 serves as a driving roller, and rotates in contact with the outer circumferential surface of the fixing belt 310 and provides driving force to the fixing belt 310. In the present embodiment, the pressing roller 330 is a roller including a shaft, an elastic layer formed on the outer circumferential surface of the shaft, and a release layer formed on the outer circumferential surface of the elastic layer. The shaft is made of stainless steel. The elastic layer has a thickness of 5 mm, and is made of silicone rubber. The release layer has a thickness of 50 μm, and is made of PFA (tetrafluoroethylene-perfluoroalkoxy ethylene copolymer) that is a fluororesin. The pressing roller 330 is rotatably supported by the fixing frame 380 of the fixing apparatus 8. In addition, the pressing roller 330 has a gear fixed to one end portion of the pressing roller 330, and is coupled with a motor M0 via the gear. Thus, the pressing roller 330 is rotated by the motor M0, which serves as a pressing-roller driving source.

The fixing frame 380 includes a heating-unit positioning portion 381, a pressing frame 383, and a pressing spring 384. The heating unit 300 is positioned with respect to the fixing frame 380 such that the stay 360 is inserted into the heating-unit positioning portion 381 and the stay 360 is fixed to the heating-unit positioning portion 381 via a fixing member (not illustrated). The heating-unit positioning portion 381 includes a pressing-direction regulation surface 381*a* that faces the pressing roller 330, and a conveyance-direction regulation surface 381*b* that is an abutment surface that the heating unit 300 abuts against in the insertion direction of the heating unit 300. The stay 360 is fixed to the heating-unit positioning portion 381 in a state where the stay 360 is prevented from moving by the pressing-direction regulation surface 381*a* and the conveyance-direction regulation surface 381*b*. When the heating unit 300 is positioned with respect to the heating-unit positioning portion 381, the pressing roller 330 is located, separated from the fixing belt 310.

After the heating unit 300 is positioned with respect to the heating-unit positioning portion 381, the pressing frame 383 is moved by a driving source and a cam (both not illustrated), so that the pressing roller 330 abuts against the fixing belt 310. Then the pressing roller 330 is pressed against the fixing pad 320 via the fixing belt 310. That is, in the present embodiment, the pressing roller 330 serves also as a pressing member that is pressed against the fixing belt 310. In the present embodiment, the force applied when an image is formed is 980 N.

In addition, in the present embodiment, a separation apparatus 400 is disposed downstream of the nip portion N in the recording-material conveyance direction. The separation apparatus 400 includes a separation member 401 (i.e., separation plate in the present embodiment) that separates a recording material from the fixing belt 310. The separation member 401 is disposed such that a clearance is formed between the separation member 401 and the outer circumferential surface of the fixing belt 310; and separates a recording material that has passed through the nip portion N, from the fixing belt 310. Specifically, the separation member 401 is disposed closer to a portion of the outer circumferential surface of the fixing belt 310, stretched between the fixing pad 320 and the heating roller 340. The separation member 401 is formed like a blade, and the leading edge of the separation member 401 faces the outer circumferential surface of the fixing belt 310. The separation member 401 includes a metal plate, and a fluorine-based tape that is stuck on the metal plate. The fluorine-based tape is provided for preventing the toner on a recording material from adhering to the metal plate when the recording material slides on the separation member 401, and for preventing scratch from being formed on an image. Thus, in the present embodiment, the stay 360 is positioned in the recording-material conveyance direction (i.e., lateral direction of the stay 360 or X direction), such that the clearance is formed between the separation member 401 and the outer circumferential surface of the fixing belt 310.

The fixing apparatus 8 configured as described above heats a toner image in the nip portion N formed between the fixing belt 310 and the pressing roller 330, while causing the fixing belt 310 and the pressing roller 330 to nip and convey a recording material P that bears the toner image. With this operation, the toner image is melted and fixed to the recording material.

Heating Roller

Figure 3A:
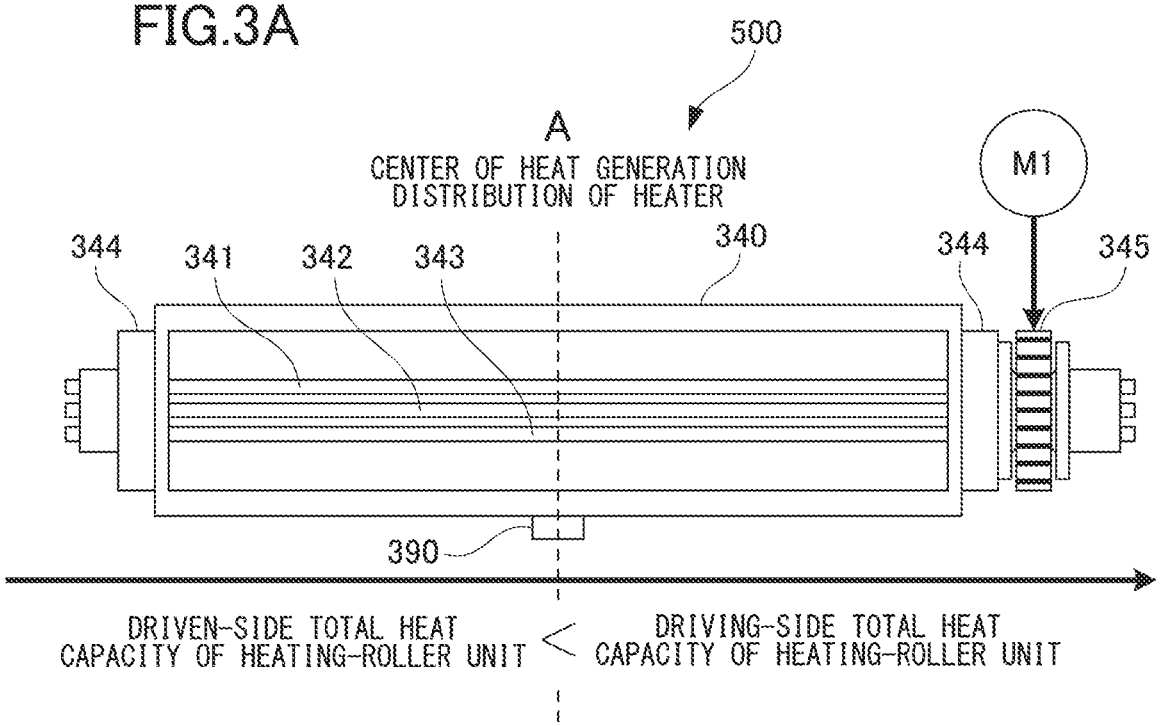
FIG. 3A is a cross-sectional view of a schematic configuration of a heating roller of the first embodiment, taking along a longitudinal direction of the heating roller.

Next, the heating roller 340 of the present embodiment will be further described with reference to FIG. 3A. As described above, the heating roller 340 serves as a contact rotation portion, and stretches the fixing belt 310. That is, the heating roller 340 is in contact with the inner circumferential surface of the fixing belt 310 along the width direction (i.e., longitudinal direction or main scanning direction) that intersects the rotational direction of the fixing belt 310. In the present embodiment, the width direction is substantially parallel with the rotation-axis direction of the heating roller 340. Both end portions of the heating roller 340 are supported by the fixing frame 380 (FIG. 2) via bearings 344 such that the heating roller 340 can rotate. In addition, the gear 345 is disposed on one end portion of the heating roller 340 in the rotation-axis direction (i.e., one end portion in the width direction). The gear 345 serves as a rotation transmission portion. The gear 345 is rotated together with the heating roller 340, by the driving force transmitted from the motor M1, which serves as a driving source. In other words, the heating roller 340 is coupled with the motor M1 via the gear 345.

In the present embodiment, the heating roller 340, the bearings 344 disposed on both end portions of the heating roller 340, and the gear 345 disposed on the one end portion of the heating roller 340 constitute a heating-roller unit 500, which serves as a rotary member. In the heating-roller unit 500, one end side (i.e., the gear 345 side) with respect to a center A in the width direction has a larger heat capacity than that of the other end side. The reason is as follows. Since the heating roller 340 and the bearings 344, disposed on both end portions of the heating roller 340, are substantially symmetric with respect to the center A in the width direction, the one end side of the heating roller 340 and one bearing 344 have substantially the same heat capacity as that of the other end side and the other bearing 344. However, since the gear 345 is disposed only on the one end portion of the heating roller 340 in the width direction and not on the other end portion, the one end side (driven by the motor M1) of the heating-roller unit 500, which includes the gear 345, with respect to the center A in the width direction has a larger heat capacity than that of the other end side.

The heating roller 340 is in contact with the inner circumferential surface of the fixing belt 310, and the fixing belt 310 contacts a recording material that passes through the nip portion N. Thus, a maximum-width area that corresponds to the maximum width of recording materials used for the fixing apparatus 8 is in the heating roller 340. In the present embodiment, the fixing is performed on a center-reference basis. Specifically, a recording material passes through the nip portion N such that the center of the recording material in the width direction is substantially made equal to the center of the fixing belt 310 in the width direction. Thus, the center of the maximum-width area in the width direction is substantially equal to the center of the heating roller 340 in the width direction. Consequently, in the heating-roller unit 500, the one end side even with respect to the center of the maximum-width area in the width direction has a larger heat capacity than that of the other end side. That is, the heat capacity distribution of the heating-roller unit 500 is asymmetric with respect to the center A in the width direction. Specifically, as illustrated in FIG. 3A, the driving-side total heat capacity of the one end side (with respect to the center A in the width direction) of the heating-roller unit 500 is larger than the driven-side total heat capacity of the other end side of the heating-roller unit 500.

Pressing Roller

Figure 3B:
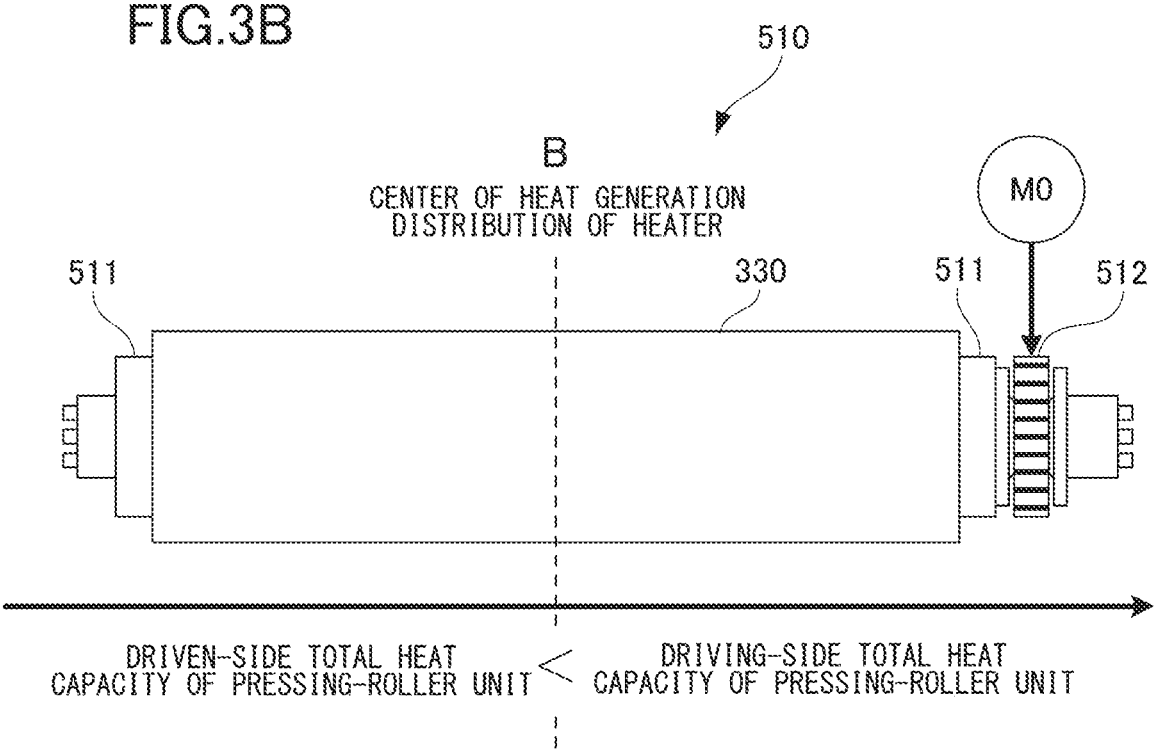
FIG. 3B is a plan view of a schematic configuration of a pressing roller of the first embodiment.

The pressing roller 330 is in contact with the outer circumferential surface of the fixing belt 310 along the width direction (i.e., longitudinal direction or main scanning direction) that intersects the rotational direction of the fixing belt 310. Similar to the heating roller 340, one end portion of the pressing roller 330 in the width direction receives driving force from the motor M0. As illustrated in FIG. 3B, both end portions of the pressing roller 330 are supported by the pressing frame 383 (FIG. 2) via bearings 511 such that the pressing roller 330 can rotate. In addition, a gear 512 is disposed on one end portion of the pressing roller 330 in the rotation-axis direction (i.e., one end portion in the width direction). The gear 512 is rotated together with the pressing roller 330, by the driving force transmitted from the motor M0, which serves as a driving source.

In the present embodiment, the pressing roller 330, the bearings 511 disposed on both end portions of the pressing roller 330, and the gear 512 disposed on the one end portion of the pressing roller 330 constitute a pressing-roller unit 510, which serves as a rotary driving member. In the pressing-roller unit 510, one end side (i.e., the gear 512 side) with respect to a center B in the width direction has a larger heat capacity than that of the other end side. The reason is as follows. Since the pressing roller 330 and the bearings 511, disposed on both end portions of the pressing roller 330, are substantially symmetric with respect to the center B in the width direction, the one end side of the pressing roller 330 and one bearing 511 have substantially the same heat capacity as that of the other end side and the other bearing 511. However, since the gear 512 is disposed only on the one end portion of the pressing roller 330 in the width direction and not on the other end portion, the one end side (driven by the motor M0) of the pressing-roller unit 510, which includes the gear 512, with respect to the center B in the width direction has a larger heat capacity than that of the other end side. That is, the heat capacity distribution of the pressing-roller unit 510 is asymmetric with respect to the center B in the width direction. Specifically, as illustrated in FIG. 3B, the driving-side total heat capacity of the one end side (with respect to the center B in the width direction) of the pressing-roller unit 510 is larger than the driven-side total heat capacity of the other end side of the pressing-roller unit 510.

Halogen Heaters

Figure 4:
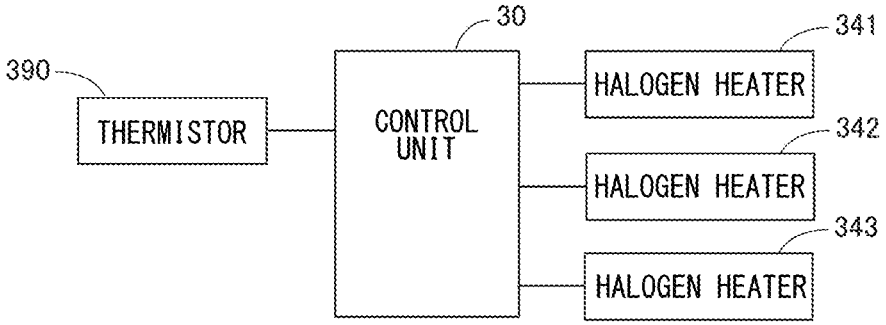
FIG. 4 is a block diagram related to temperature control of halogen heaters of the first embodiment.

Next, the halogen heaters 341, 342, and 343 will be described with reference to FIGS. 3 to 6. As described above, the plurality of halogen heaters 341, 342, and 343 are disposed inside the heating roller 340 along the rotation-axis direction (width direction) of the heating roller 340. As illustrated in FIG. 4, the halogen heaters 341, 342, and 343 generate heat when current flows through the halogen heaters 341, 342, and 343 under the control performed by a control unit 30. The control unit 30 performs the control, depending on a temperature detected by a thermistor 390 disposed in contact with a center portion of the outer circumferential surface of the heating roller 340 in the width direction.

Each of the halogen heaters 341, 342, and 343 includes a pipe, and a tungsten filament disposed in the pipe. The pipe is filled with a halogen gas having a predetermined concentration. In the present embodiment, the halogen heaters 341, 342, and 343 have an identical light distribution (output distribution), and the temperature control is performed such that the halogen heaters 341, 342, and 343 are simultaneously turned on and off. The light distribution of the halogen heaters 341, 342, and 343 obtained when the halogen heaters 341, 342, and 343 are simultaneously turned on is set as illustrated in a graph in a lower portion of FIG. 5.

The output distribution of each of the halogen heaters 341, 342, and 343 in the width direction is asymmetric with respect to the center A, and the output in a first area is larger than the output in a second area. The first area corresponds to the one end side of the heating roller 340 with respect to the center A in the width direction, and the second area corresponds to the other end side of the heating roller 340. Thus, the output distribution of the three halogen heaters 341, 342, and 343 in the width direction, obtained when all the halogen heaters are turned on, is the same as that illustrated by the graph in a lower portion of FIG. 5. Thus, in the present embodiment, the heat distribution (light distribution) of each halogen heater is asymmetric with respect to the center A of the heat generating portion in the width direction (that is, the right side and the left side of the heat distribution are asymmetric to each other). In the present embodiment, the rated value of each of the halogen heaters 341, 342, and 343 is set at 1000 W. In the present embodiment, the heat distribution of each heater is measured by applying the rated power to the heater for causing the heater to generate heat, and by detecting the heat at a position separated from the heater by 20 mm. Note that the asymmetric heater is defined as a heater in which the difference between the peak value of heat and the value of heat at a center portion (center) is equal to or larger than 15% and equal to or smaller than 60%, as illustrated in FIG. 6. On the other hand, the symmetric heater is defined as a heater in which the difference between the peak value of heat and the value of heat at a center portion (center) is less than 10%. The heater of the present embodiment is an asymmetric heater because the difference between the peak value of heat in the right area and the peak value of heat in the left area is up to 15%, as illustrated in FIG. 6.

Figure 5:
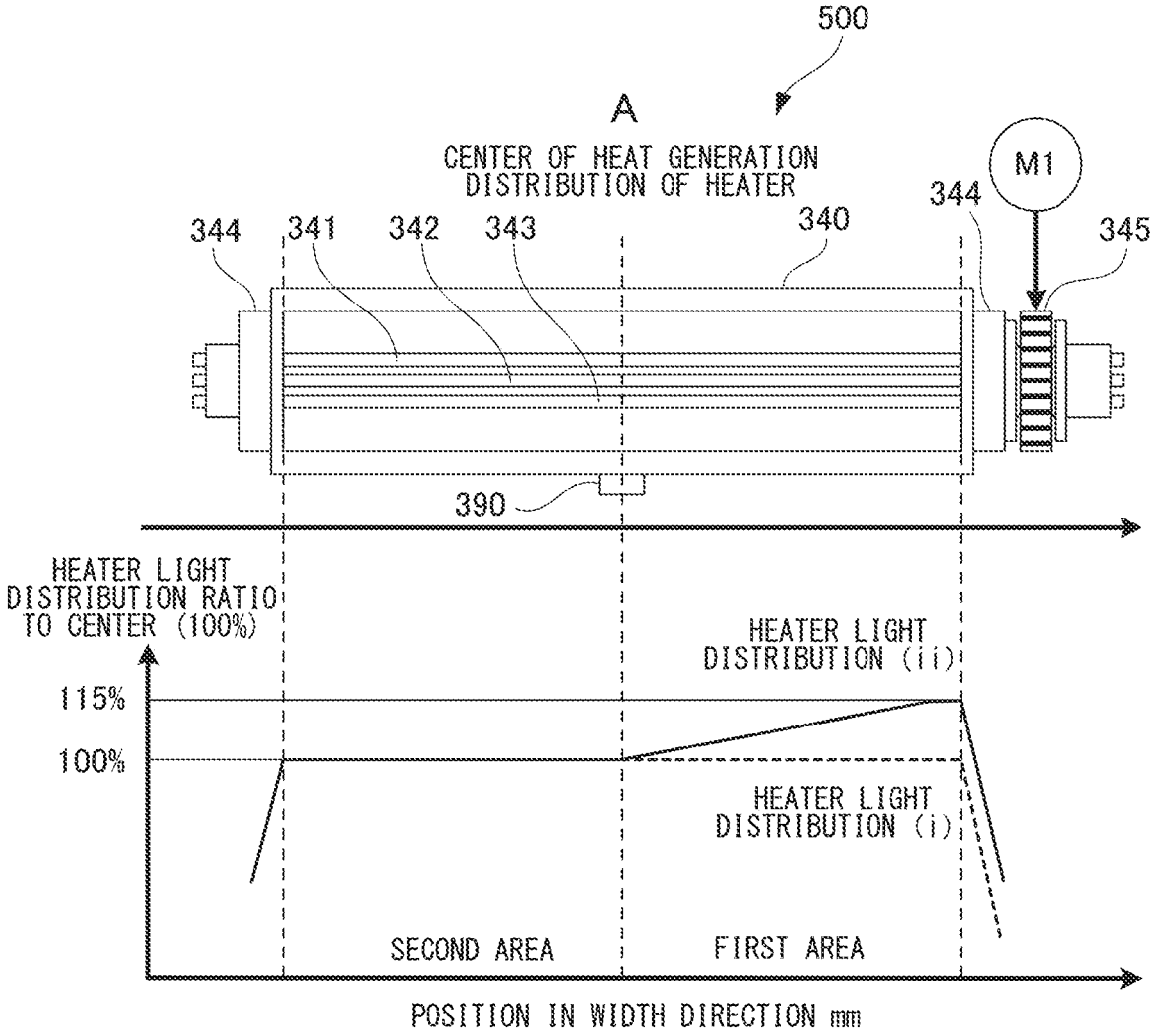
FIG. 5 illustrates a light distribution of halogen heaters of the first embodiment in the longitudinal direction of the halogen heaters, and illustrates a light distribution of halogen heaters of a comparative example in the longitudinal direction of the halogen heaters.
Figure 6:
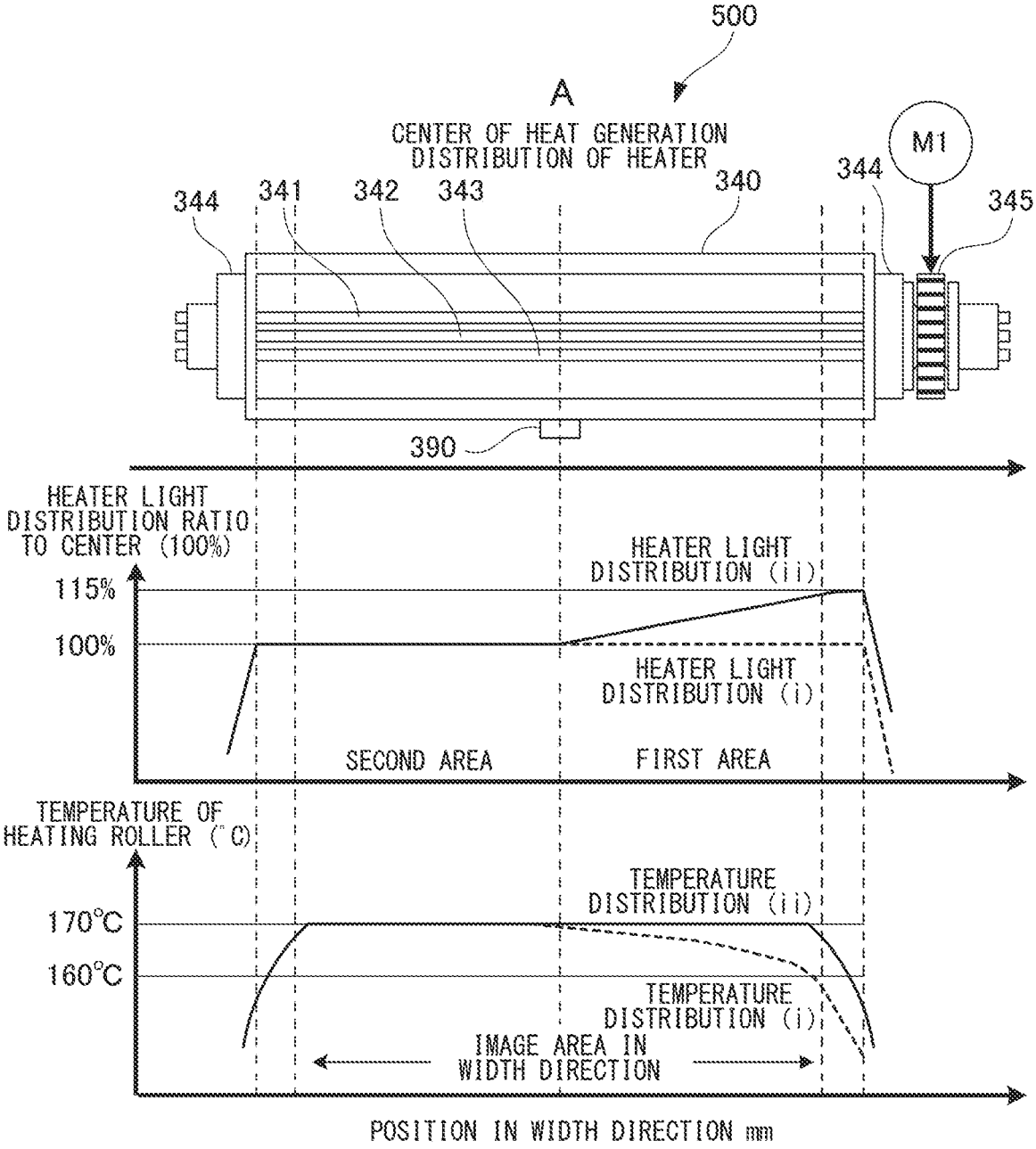
FIG. 6 illustrates a light distribution and a temperature distribution of halogen heaters of the first embodiment in the longitudinal direction of the halogen heaters, and illustrates a light distribution and a temperature distribution of halogen heaters of a comparative example in the longitudinal direction of the halogen heaters.

In FIG. 5, a heater light distribution (ii) indicates the light distribution of each of the halogen heaters 341, 342, and 343 of the present embodiment, and a heater light distribution (i) indicates a light distribution of halogen heaters of a comparative example that is symmetric with respect to the center A in the width direction. The amount of heater light (output) is determined relative to the amount of heater light (100%) at the center A in the width direction. In the present embodiment, the heater light distribution (ii) is set such that the amount of heater light increases linearly from the value at the center A to a value of 115% at the one end portion on which side the gear 345 is provided. On the other hand, the heater light distribution (i) of the comparative example is set such that the amount of heater light is 100% in the whole area.

That is, in the output distribution of each of the halogen heaters 341, 342, and 343 of the present embodiment, the maximum value in the first area is larger than the maximum value in the second area. The same holds true for the output distribution obtained when all the halogen heaters 341, 342, and 343 are simultaneously turned on. In addition, in the first area of the halogen heaters 341, 342, and 343, the output at a first position is larger than the output at a second position that is located closer to the center portion than the first position is, in the width direction. The same holds true for the output distribution obtained when all the halogen heaters 341, 342, and 343 are simultaneously turned on.

Temperature Distribution of Heating Roller in Width Direction

FIG. 6 illustrates a heater light distribution and a temperature distribution of the heating roller 340 in the width direction, obtained when the heating unit 300 (FIG. 2) is driven. When the heating unit 300 is driven, current flows through the halogen heaters 341, 342, and 343 for causing the halogen heaters 341, 342, and 343 to generate heat, and the driving force is given from the motor M1 to the gear 345 for rotating the heating roller 340. In addition, the control unit 30 controls the temperature of the halogen heaters 341, 342, and 343 such that the temperature of the thermistor 390 is 170° C. The temperature control is so-called OFF/ON control that de-energizes all the halogen heaters 341, 342, and 343 when the thermistor 390 detects a temperature of 170° C. or more, and that energizes all the halogen heaters 341, 342, and 343 when the thermistor 390 detects a temperature of 168° C. or less.

In the heater light distribution (i) of the comparative example, the temperature distribution of the heating roller 340 in the width direction slants such that the temperature at the center A decreases to the temperature at one end portion (on which side the gear 345 is provided), by about 10° C. In contrast, in the heater light distribution (ii) of the present embodiment, the temperature distribution is kept uniformly at 170° C. in an image area in the width direction. Note that the image area corresponds to a maximum-size image formed in a maximum-width recording material that can be used for the fixing apparatus 8. Specifically, the image area is equal to or slightly smaller than the above-described maximum-width area.

In the comparative example, since the temperature of the heating roller 340 decreases in the one end side of the image area in the width direction, failure of the fixing may occur in the area in which the temperature decreases. In contrast, in the present embodiment, since the temperature distribution can be kept uniformly in the image area, such failure of the fixing can be suppressed. That is, in the present embodiment, even if the heat capacity distribution of the heating-roller unit 500, which serves as a rotary member, is asymmetric in the width direction, the failure of the fixing can be suppressed from occurring. In other words, the surface-temperature distribution of the heating roller 340 in the width direction can be made uniform by setting the light distribution of the halogen heaters 341, 342, and 343 in consideration of the heat capacity distribution of the heating roller 340 in the width direction. As a result, the failure of the fixing can be suppressed from occurring. In the present embodiment, the belt fixing apparatus is used, and the belt is stretched by and wound around the heating roller and the stretching member. Since the belt has less heat capacity, the belt fixing apparatus has advantageously higher thermal responsivity than that of conventional fixing apparatuses having a roller pair. In addition, the thermal responsivity can be further increased by decreasing the heat capacity of the heating roller that heats the belt. Since a fixing roller of a conventional roller pair has larger heat capacity, a sufficient amount of heat has to be applied to the fixing roller until the temperature of the fixing roller reaches a target temperature. When the temperature of the fixing roller reaches the target temperature, unevenness in temperature of the fixing roller hardly occurs in the longitudinal direction because the whole of the fixing roller has been heated sufficiently. In contrast, if the heating roller has less heat capacity, the temperature of a center portion reaches a target temperature easier than the temperature of an end portion does. Thus, there is a tendency that the end portion is not supplied with a sufficient amount of heat. As countermeasures, a heater that generates heat more from an end portion than from a center portion can be used. However, if the heating roller is provided with a gear, the heater cannot cover the heat capacity of the gear if no measure is taken as in the comparative example. The present invention solves this problem.

In addition, in the present embodiment, also in the pressing-roller unit 510 that includes the pressing roller 330, the one end side in the width direction has larger heat capacity than that of the other end side, as in the heating-roller unit 500. Thus, the temperature of the pressing-roller unit 510 more easily decreases in the one end side of the image area in the width direction, as in the comparative example. In the present embodiment, however, the light distribution of the halogen heaters 341, 342, and 343 in the width direction is set also in consideration of the heat capacity distribution of the pressing-roller unit 510. Thus, the temperature can be suppressed from decreasing in the one end side of the pressing-roller unit 510 in the width direction, and the failure of the fixing can be suppressed from occurring.

Note that although the fixing member is a belt in the present embodiment, the pressing member may be a belt, or both of the fixing member and the pressing member may be belts. In addition, although the number of the halogen heaters 341, 342, and 343 is three in the present embodiment, the number may be two or more as long as a plurality of halogen heaters is used. In addition, although the heaters have an identical light distribution in the present embodiment, any one or all of the heaters may have different light distributions as long as the light distribution as illustrated in FIG. 5 is obtained when all the heaters are turned on.

Second Embodiment

Next, a second embodiment will be described with reference to FIG. 2 and FIGS. 7 to 10. In the above-described first embodiment, the description has been made for the case where the three halogen heaters 341 to 343 have an identical light distribution and the temperature control is performed by using the single thermistor 390. In the present embodiment, at least one of the plurality of heaters has a different light distribution, and the temperature control is performed by using two thermistors. Since the other configuration and operation are the same as those of the above-described first embodiment, a component identical to a component of the first embodiment is given an identical symbol, duplicated description and illustration will be omitted or simplified, and features different from the first embodiment mill be mainly described below.

The fixing apparatus 8 becomes warm if an image forming job, in which recording materials successively pass through the nip portion N, is performed for a long time, or an intermittent job, which is an image forming job performed at a relatively short interval, is performed many times. Note that the image forming job is performed depending on a print signal (image forming signal) for forming an image on a recording material, and involves a period of time from when the image formation is started until when the image formation is completed.

If the fixing apparatus 8 has become warm to some extent, the amount of heat applied for controlling the temperature of the heating roller 340 at a predetermined temperature becomes smaller than the amount of heat applied to the heating roller 340 in a state where the heating roller 340 has still not been warm. For making the temperature distribution of the heating roller 340 uniform in the width direction, heat is applied to the heating roller 340. The difference between the amount of heat applied to the gear 345 side and the amount of heat applied to the other side, obtained after the fixing apparatus 8 becomes warm, is smaller than the difference obtained before the fixing apparatus becomes warm. The boundary between the gear 345 side and the other side is located at a position of the center A of the heating roller 340 in the width direction. In the present embodiment, the temperature distribution of the heating roller 340 in the width direction can be made uniform before and after the fixing apparatus 8 becomes warm.

Figure 7:
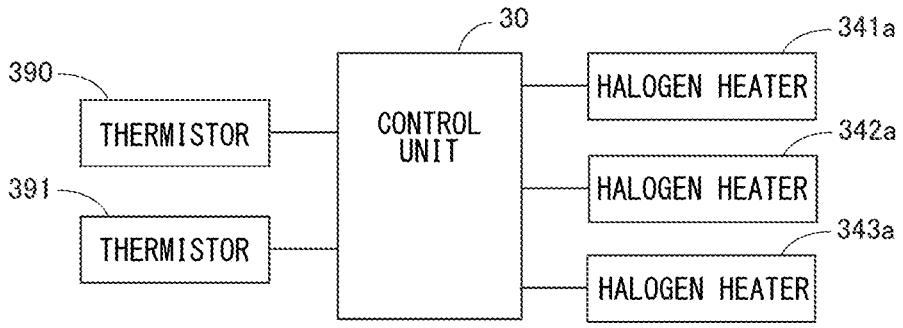
FIG. 7 is a block diagram related to temperature control of halogen heaters of a second embodiment.
Figure 8:
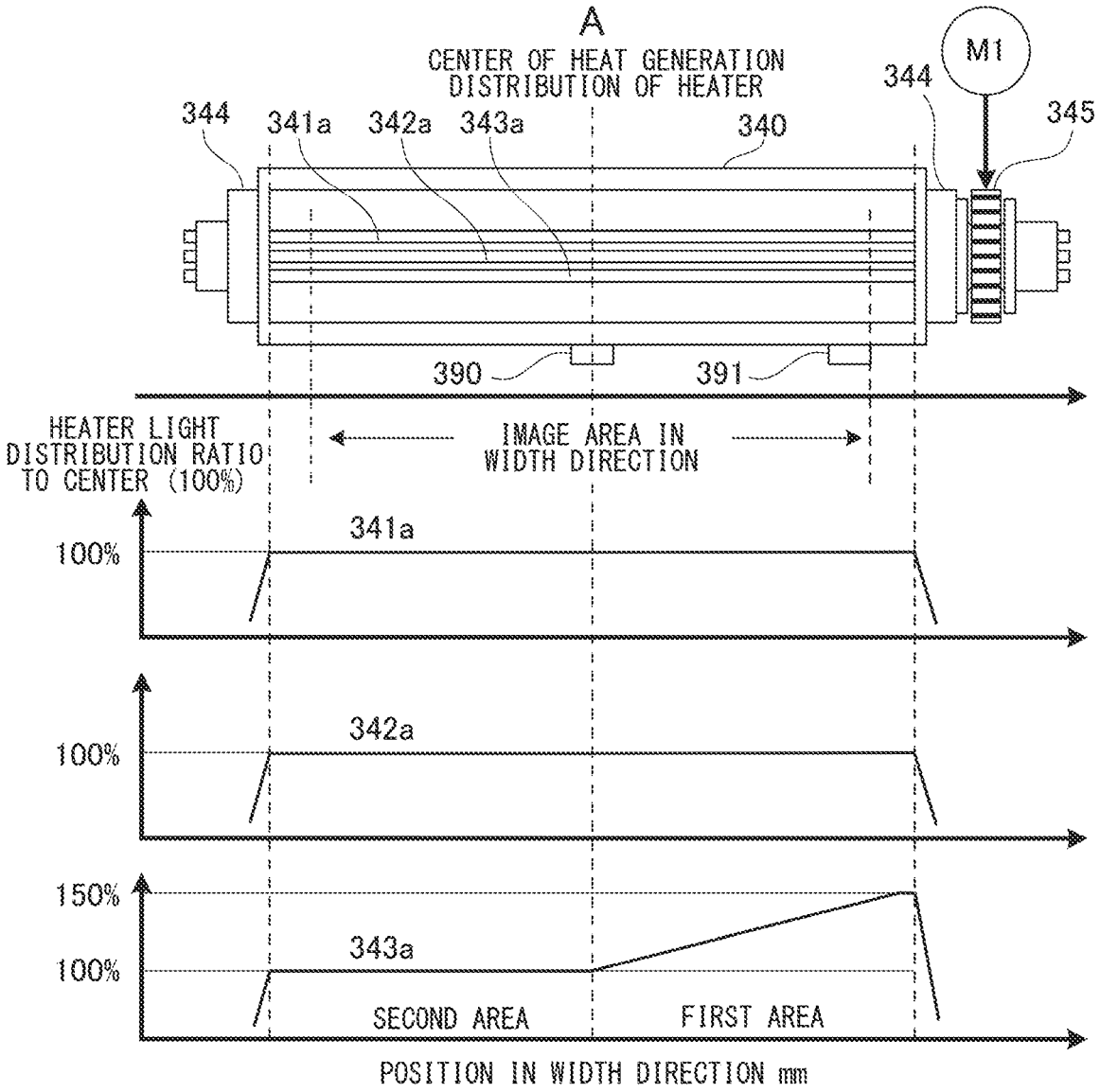
FIG. 8 illustrates light distributions of halogen heaters of the second embodiment in the longitudinal direction of the halogen heaters.

As illustrated in FIGS. 7 and 8, in the present embodiment, a thermistor 391 is additionally disposed in the configuration of the first embodiment. The thermistor 391 is disposed in contact with an end portion of the image area on the one end side of the heating roller 340 in the width direction. In addition, light distributions of halogen heaters 341*a*, 342*a*, and 343*a* are set as illustrated in a graph in a lower portion of FIG. 8. The rated power of each of halogen heaters 341*a*, 342*a*, and 343*a* is 1000 W.

In the present embodiment, the halogen heater (first heater) 343*a*, which is one of the plurality of halogen heaters 341*a*, 342*a*, and 343*a*, has an output distribution that is asymmetric with respect to the center A in the width direction. In addition, in the output distribution of the halogen heater 343*a*, the output in a first area on the one end side in the width direction is larger than the output in a second area on the other end side in the width direction. On the other hand, the halogen heaters (second heaters) 341*a* and 342*a*, which are the other heaters of the plurality of halogen heaters 341*a*, 342*a*, and 343*a* have an output distribution different from that of the halogen heater 343*a*, which is the first heater. Thus, since the number of the second heaters is larger than that of the first heater, the end portion of the heating roller 340 on the gear side can be heated more, while suppressed from being overheated.

In the present embodiment, the belt fixing apparatus is used, and the belt is stretched by and wound around the heating roller and the stretching member. Since the belt has less heat capacity, the belt fixing apparatus has advantageously higher thermal responsivity than that of conventional fixing apparatuses having a roller pair. In addition, the thermal responsivity can be further increased by decreasing the heat capacity of the heating roller that heats the belt. Since a fixing roller of a conventional roller pair has larger heat capacity, a sufficient amount of heat has to be applied to the fixing roller until the temperature of the fixing roller reaches a target temperature. When the temperature of the fixing roller reaches the target temperature, unevenness in temperature of the fixing roller hardly occurs in the longitudinal direction because the whole of the fixing roller has been heated sufficiently. In contrast, if the heating roller has less heat capacity, the temperature of a center portion reaches a target temperature easier than the temperature of an end portion does. Thus, there is a tendency that the end portion is not supplied with a sufficient amount of heat. As countermeasures, a heater that generates heat more from an end portion than from a center portion can be used. However, if the heating roller is provided with a gear, the heater cannot cover the heat capacity of the gear if no measure is taken as in the comparative example. The present invention solves this problem.

Specifically, as illustrated in the graph in a lower portion of FIG. 8, the output distribution (light distribution) of the halogen heaters 341*a* and 342*a*, which serve as the second heaters, is symmetric with respect to the center A in the width direction, and is constant in the whole area. In contrast, the output distribution (light distribution) of the halogen heater 343*a*, which serves as the first heater in the width direction is set such that the output increases linearly from a value at the center A to a value al a position at which the gear 345 is disposed. That is, in the output distribution of the halogen heater 343*a*, the maximum value in the first area is larger than the maximum value in the second area. In addition, in the first area of the halogen heater 343*a*, the output at a first position is larger than the output at a second position that is located closer to the center portion than the first position is, in the width direction.

In addition, in the present embodiment, the thermistor 390 serves as a first temperature-detection member, and detects the temperature of a center portion of the heating roller 340 in the width direction (the heating roller 340 serves as a contact rotation portion). Specifically, the thermistor 390 is disposed at a position of the center A of the outer circumferential surface of the heating roller 340 in the width direction. In addition, the thermistor 391 serves as a second temperature-detection member, and detects the temperature of a portion of the heating roller 340, located closer to the one end of the heating roller 340 than the center A in the width direction. Specifically, the thermistor 391 is disposed at a position of an end portion of the image area on the one end side of the outer circumferential surface of the heating roller 340 in the width direction.

As illustrated in FIG. 7, the control unit 30 controls the halogen heaters 341*a*, 342*a*, and 343*a*, depending on temperatures detected by the thermistors 390 and 391. In the present embodiment, the halogen heaters 341*a* and 342*a* are turned off if the temperature detected by the thermistor 390 reaches a first threshold value (for example, 170° C.). On the other hand, the halogen heater 343*a* is turned off if the temperature detected by the thermistor 391 reaches a second threshold value (for example, 170° C.). The first threshold value and the second threshold value may be equal to each other, or may be different from each other.

Temperature Control

Next, temperature control of the halogen heaters 341*a*, 342*a*, and 343*a* of the present embodiment will be specifically described. The control unit 30 causes current to flow through the halogen heaters 341*a* and 342*a* depending on the temperature detected by the thermistor 390, and causes the halogen heaters 341*a* and 342*a* to generate heat until the temperature reaches a target temperature (first threshold value). In addition, the control unit 30 causes current to flow through the halogen heater 343*a* depending on the temperature detected by the thermistor 391, and causes the halogen heater 343*a* to generate heat until the temperature reaches a target temperature (second threshold value). The control method is the same as that of the first embodiment. That is, the control unit 30 continues to energize a halogen heater until a corresponding target temperature is reached, and de-energizes the halogen heater when the target temperature is reached. When the temperature detected by a corresponding thermistor decreases and becomes lower than the target temperature by 2° C. or more, the control unit 30 re-energizes the halogen heater for stabilizing the temperature detected by the thermistor, in the vicinity of the target temperature.

In a period of time from the startup of the fixing apparatus 8 to an early stage of an image forming job, since the fixing apparatus 8 is not warm, the halogen heaters 341*a*, 342*a*, and 343*a* are subjected to the energization ON/OFF control, almost in synchronization with each other. However, as the fixing apparatus 8 becomes warm, the non-energization time of the halogen heater 343*a* increases. Thus, when the fixing apparatus 8 is started up, and when the fixing apparatus 8 becomes or is warm after the startup, the temperature distribution can be made uniform in the width direction, by the control.

Figure 9:
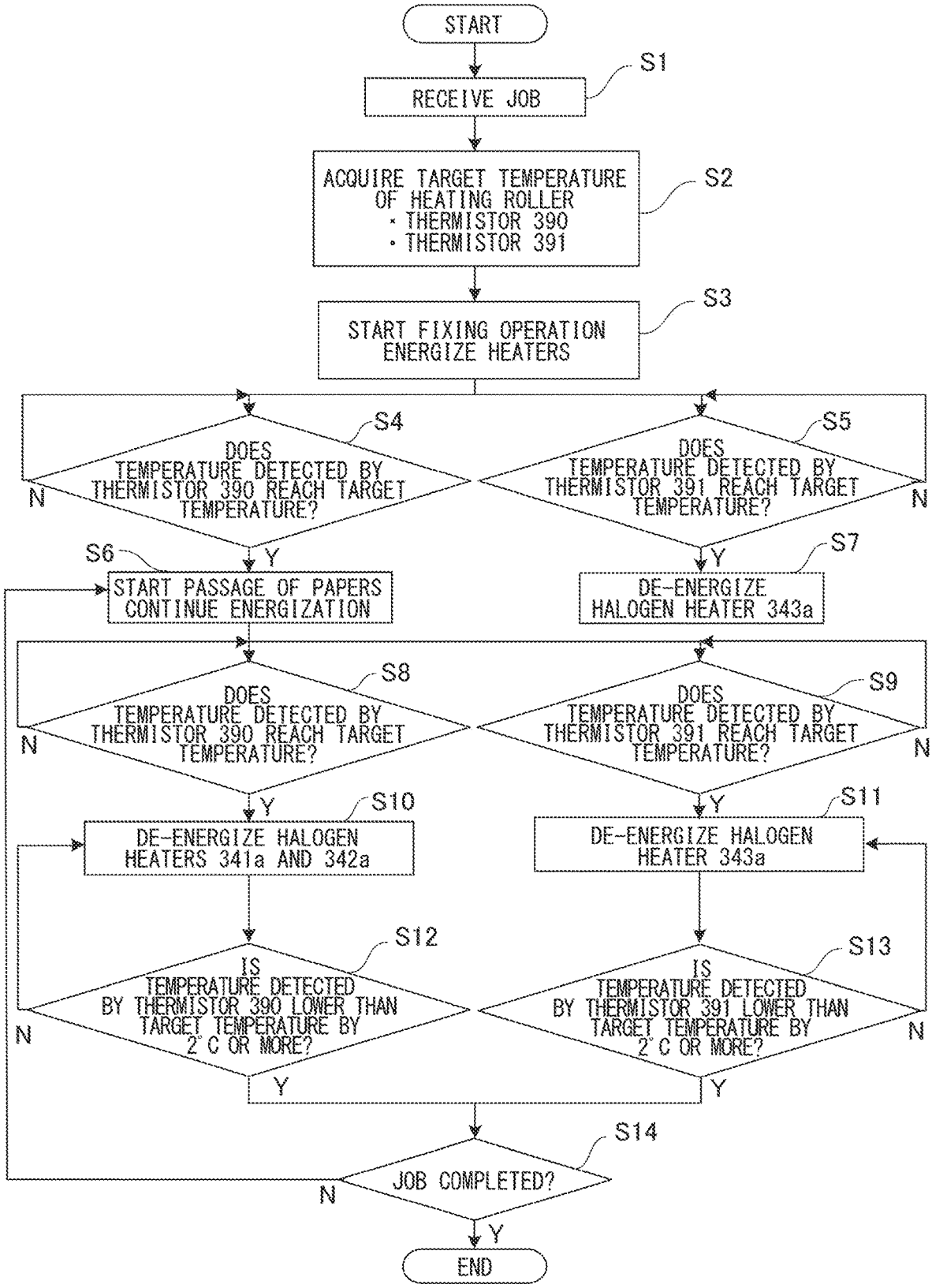
FIG. 9 is a flowchart illustrating temperature control of the heaters of the second embodiment.

Next, a specific example of the present embodiment will be described with reference to FIG. 9. FIG. 9 illustrates a flowchart of temperature control of the present embodiment, performed in a successive-image-forming job in which recording materials successively pass through the nip portion N. For example, the conditions of the successive-image-forming job are as follows: the recording materials are paper sheets, the type of the paper sheets is OK Topcoat made by Oji Paper Co., Ltd., the grammage of the paper sheets is 157 g/m$^2$, and the size of the paper sheets is A4. In addition, both of the thermistors 390 and 391 have a target temperature of 170° C., and 80 paper sheets pass through the fixing apparatus 8 per minute.

Upon receiving an instruction for the successive-image-forming job (S1), the control unit 30 obtains a target temperature of the heating roller 340 in accordance with a type of the job (S2). The target temperature is defined as a temperature with which temperatures detected by the thermistors 390 and 391 are compared. Then the control unit 30 starts to rotate the rollers of the fixing apparatus 8, and cause current to flow through the halogen heaters 341*a*, 342*a*, and 343*a* (S3).

The control unit 30 obtains temperatures detected by the thermistors 390 and 391, and compares the temperatures with the target temperature (S4, S5). If the temperature detected by the thermistor 390 is higher than the target temperature (S4: Y), then the control unit 30 sends a sheet-passage-start instruction, and starts to send sheets into the nip portion N (S6). If the temperature detected by the thermistor 391 is higher than the target temperature (S5: Y), then the control unit 30 de-energizes the halogen heater 343*a* (S7).

Then the control unit 30 obtains temperatures detected by the thermistors 390 and 391, and compares the temperatures with the target temperature (S8, S9). If the temperature detected by the thermistor 390 is higher than the target temperature (S8: Y), then the control unit 30 de-energizes the halogen heaters 341*a* and 342*a* (S10); and if the temperature detected by the thermistor 391 is higher than the target temperature (S9: Y), then the control unit 30 de-energizes the halogen heater 343*a* (S11). Then the control unit 30 obtains temperatures detected by the thermistors 390 and 391, and compares the temperatures with the target temperature (S12, S13). If the temperature detected by the thermistor 390 is lower than the target temperature by 2° C. or more (S12: Y), then the control unit 30 checks if the image forming job is completed (S14); and if the temperature detected by the thermistor 391 is lower than the target temperature by 2° C. or more (S13: Y), then the control unit 30 checks if the image forming job is completed (S14). The control unit 30 ends the control if the job is completed, or proceeds to Step S6 if the job is not completed.

Figure 10:
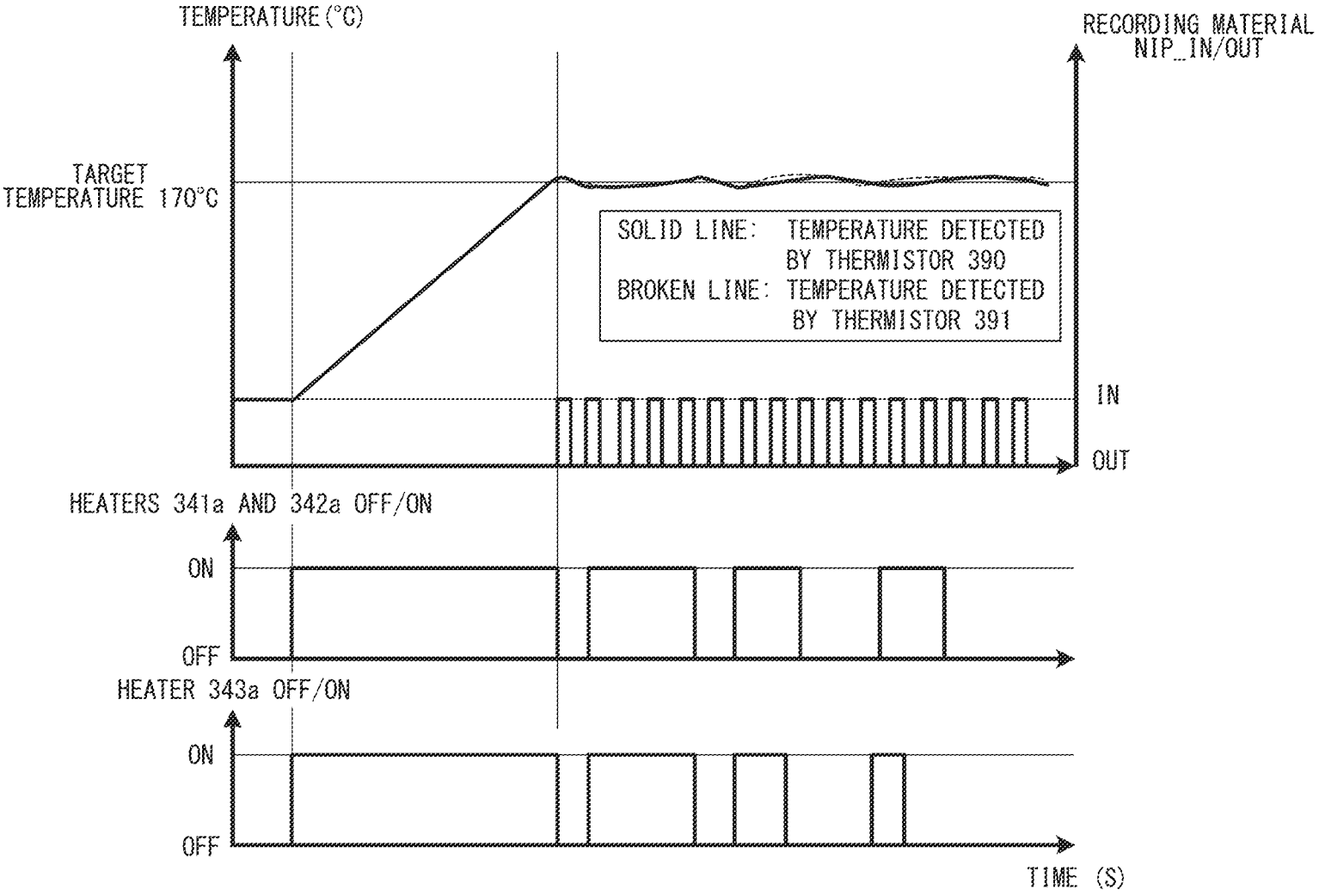
FIG. 10 is a timing chart illustrating a relationship between the temperature of the heaters of the second embodiment and ON/OFF of the heaters.

FIG. 10 illustrates the progress of the above-described successive-image-forming job, the change in temperature detected by the thermistors 390 and 391, and OFF/ON timing of each heater. As illustrated in FIG. 10, until the temperature detected by the thermistor 390 reaches a target temperature of 170° C., all the halogen heaters 341*a*, 342*a*, and 343*a* are on. At a timing at which the temperature detected by the thermistor 390 reaches the target temperature, the passage of recording materials is started, and a recording material is supplied into the nip portion N. At the same timing, the temperature of the fixing belt 310 starts to decrease because the heat of the fixing belt 310 is transferred to the recording material. In addition, the temperature of the heating roller 340 also starts to decrease because the heat of the heating roller 340 is transferred to the fixing belt 310. Then the control unit 30 starts the above-described temperature control, and causes the halogen heaters 341*a*, 342*a*, and 343*a* to perform the OFF/ON operation, in accordance with temperatures detected by the thermistors 390 and 391.

As illustrated in FIG. 10, the temperatures detected by the thermistors 390 and 391 are kept close to the target temperature, by the above-described temperature control. Thus, the temperature distribution of the heating roller 340 can be kept uniform in the width direction.

As illustrated in the heater OFF/ON timing charts in a lower portion of FIG. 10, in a period of time from the startup of the fixing apparatus 8 to the first half of the successive-image-forming job, the halogen heaters 341*a*, 342*a*, and 343*a* operate in the same manner. However, in the second half of the successive-image-forming job, the ON time of the halogen heater 343*a* decreases. Therefore, even in a fixing apparatus whose heat capacity distribution is asymmetric in the width direction, the temperature distribution of the heating roller 340 can be made uniform in the width direction by appropriately controlling the halogen heater 343*a*, which is an asymmetric light-distribution heater. In addition, the temperature distribution in the width direction is easily kept uniform in a period of time from the start to the end of a fixing operation. As a result, a toner image on a recording material that passes through the fixing apparatus can be uniformly heated, so that the failure of the fixing can be prevented from occurring in an edge portion in the width direction.

Note that the light distribution of each heater of the present embodiment is applicable if the following conditions are satisfied: the heaters include a heater whose light distribution is asymmetric in the width direction as illustrated in FIG. 8 and the other heaters whose light distribution is symmetric in the main scanning direction, and the light distribution of all the heaters is asymmetric in the width direction when all the heaters are turned on. Thus, if the above-described conditions are satisfied, the combination of light distributions may be different from the combination of the present embodiment.

Other Embodiments

In the above-described embodiments, the description has been made for the case where the rotary member in which the heaters are disposed is the heating-roller unit that includes the heating roller 340 and the gear 345. However, also in a case where heaters are disposed in the pressing roller 330, it is preferable that the output characteristics of the heaters are set as described above. In this case, the pressing roller 330 serves as a contact rotation portion, and the gear 512 serves as a rotation transmission portion.

In addition, the present invention can be applied not only to the fixing apparatus that uses a belt as described above, but also to a fixing apparatus in which a fixing roller and a pressing roller form a nip portion which recording materials pass through. In this case, if a rotation transmission portion, such as a gear, is disposed on one end portion of the fixing roller, the fixing roller and the rotation transmission portion constitute a rotary member, and the heat capacity of one end side of the rotary member becomes larger than that of the other end side, as in the above-described heating-roller unit 500. For this reason, the heaters may be disposed in the fixing roller in the same manner as in the above-described embodiments. That is, the present invention can be applied to a configuration that includes a rotary member such as a roller heated by heaters, and a rotation transmission portion to transmit the rotation to the rotary member. In this configuration, since the rotation transmission portion is disposed on one end portion of the rotary member, the heat capacity of the one end side of the rotary member is larger than that of the other end side in the width direction. Note that the present invention can also be applied to another configuration other than the above-described configuration in which the rotation transmission portion is disposed on one end portion of the rotary member, as long as the heat capacity of one end side of the other configuration is larger than that of the other end side in the width direction.

In addition, although the description has been made, in the above-described embodiment, for the case where a plurality of heaters is disposed in the heating roller 340, a single heater may be disposed in the heating roller 340. In this case, the light distribution of the single heater is made equal to the distribution described in the first embodiment. In addition, one or more heaters may be disposed outside a rotary member such as the heating roller. For example, an external heating system in which the fixing belt and the heating roller are heated from the outside may be used, and the output distribution of external heaters may be set as described in the first or the second embodiment.

In addition, in the above-described embodiments, the motor M0 for the pressing roller and the motor M1 for the assistance driving roller are disposed independently. However, a single motor may be used as the motor for the pressing roller and the motor for the assistance driving roller. That is, the pressing roller and the assistance driving roller may be driven by the single driving source. In this case, a speed change mechanism is disposed between the single motor and one of the rollers so that the circumferential speed of the heating roller 340 is higher than the circumferential speed of the pressing roller 330.

In the above-described embodiments, the heating roller 340 is disposed downstream of the fixing pad 320 and upstream of the steering roller 350 in the rotational direction of the fixing belt 310. However, the position of the heating roller 340 and the position of the steering roller 350 may be switched. That is, the heating roller 340 may be disposed downstream of the steering roller 350 and upstream of the fixing pad 320 in the rotational direction of the fixing belt 310.

In addition, in the above-described embodiments, the halogen heaters are disposed in the assistance driving roller, as heaters that heat the fixing belt. However, the heaters may be disposed not in the assistance driving roller, but in another stretching member such as the steering roller. The heaters may be disposed in the pad member. For example, plate-like heat-generating members such as ceramic heaters may be disposed in a surface of the pad member on the fixing belt side. In any case, if the heaters heat a member whose heat capacity distribution is asymmetric with respect to the center of the member in the width direction, the output distribution of the heaters is also made asymmetric in accordance with the heat capacity distribution of the member.

In addition, although the nip-portion forming member is the fixing pad 320 in the above-described embodiments, the nip-portion forming member may be a rotary member such as a roller. In addition, although the rotary driving member is the pressing roller 330 in the above-described embodiments, the rotary driving member may be a belt that is rotated by a driving source.

Figure 11:
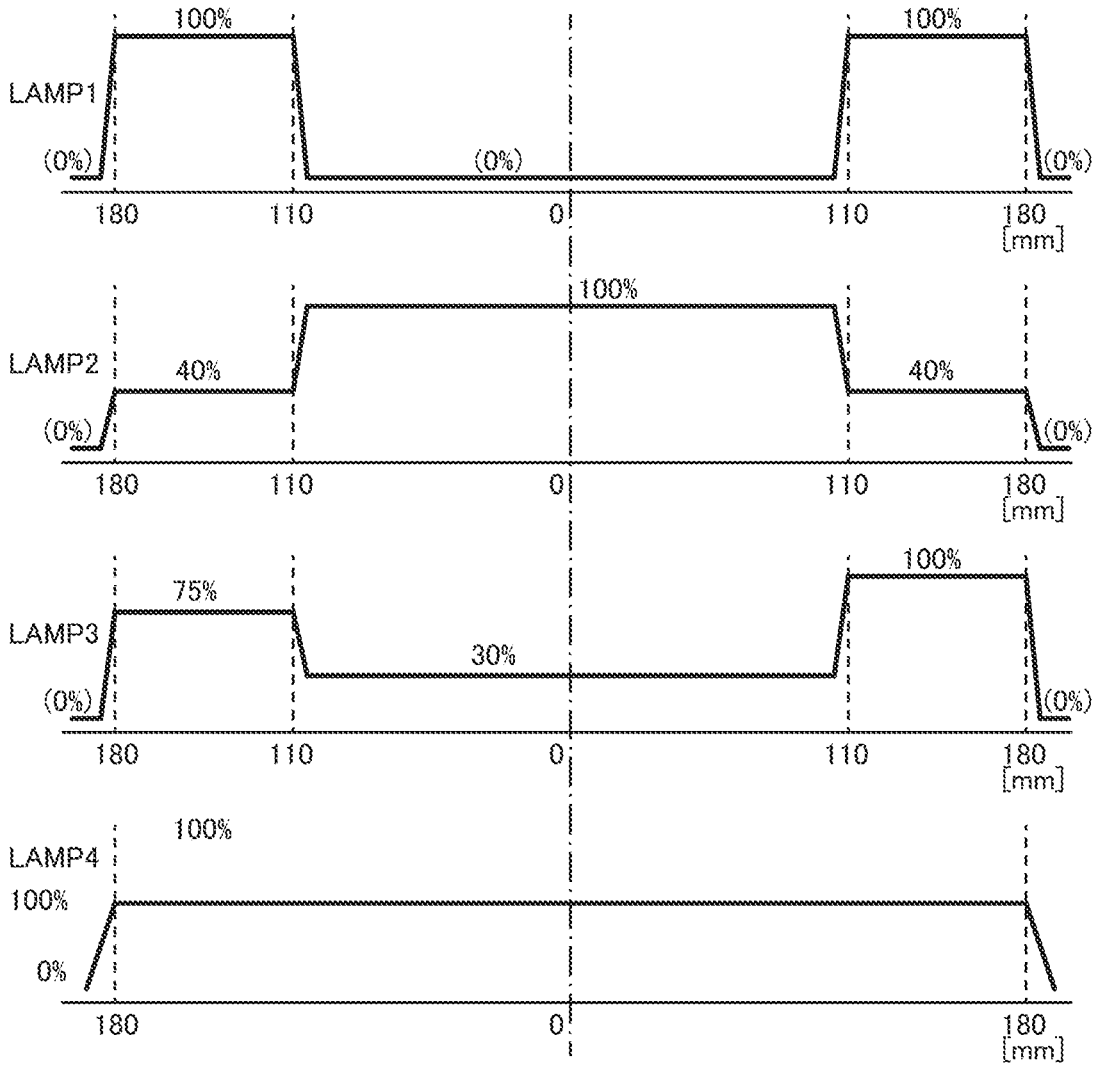
FIG. 11 illustrates heat distribution properties of tour halogen heaters of a modification.

In addition, although the number of the halogen heaters is three in the above-described embodiments, the present invention is limited to the number. For example, six halogen heaters may be used. In this case, two halogen heaters (LAMP 1 in FIG. 11) may have a symmetric heat distribution in which the amount of heat generated from an end portion is larger than the amount of heat generated from a center portion; two halogen heaters (LAMP 2 in FIG. 11) may have a symmetric heat distribution in which the amount of heat generated from a center portion is larger than the amount of heat generated from an end portion; one halogen heater (LAMP 4 in FIG. 11) may have a symmetric heat distribution in which the amount of heat is substantially uniform in the longitudinal direction; and one halogen heater (LAMP 3 in FIG. 11) may have an asymmetric heat distribution in which the amount of heat generated from an end portion is larger than the amount of heat generated from a center portion, and in which the amount of heat generated from an end portion on the gear side is larger than the amount of heat generated from an end portion on the other side.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-093137, filed May 28, 2020, which is hereby incorporated by reference herein in its entirety.

What is claimed is:

1. A fixing apparatus that fixes an image to a recording material, comprising:

an endless rotatable belt;

a heating roller comprising a plurality of halogen heaters whose number is three or more, and configured to stretch and heat the belt;

a driving-force transmission member disposed on one end portion of the heating roller and configured to transmit rotational force that rotates the heating roller;

a pressing member configured to form a nip portion in cooperation with the belt, the nip portion being a portion in which a recording material is nipped and conveyed;

a nip-portion forming member disposed in contact with an inner surface of the belt, the nip-portion forming member and the pressing member being configured to form the nip portion;

a temperature detection member configured to detect a temperature of the heating roller or the belt; and a control unit configured to control energization of each of the halogen heaters depending on output from the temperature detection member, wherein the plurality of halogen heaters whose number is three or more comprises:

at least one asymmetric halogen heater in which an amount of heat generated from one end side on which the driving-force transmission member is provided is larger than an amount of heat generated from another end side, and in which heat generation distribution is asymmetric with respect to a center of a heat generating portion in a longitudinal direction; and at least one symmetric halogen heater in which heat generation distribution is symmetric with respect to a center of a heat generating portion in a longitudinal direction, wherein the number of symmetric halogen heaters is larger than the number of asymmetric halogen heaters.

2. The fixing apparatus according to claim 1, wherein the driving-force transmission member is a gear.

3. The fixing apparatus according to claim 1, further comprising an end-portion-temperature detection member configured to detect a temperature of an end portion of the heating roller on the one end side on which the driving-force transmission member is provided, wherein the control unit is configured to control energization of the at least one asymmetric halogen heater depending on output from the end-portion-temperature detection member.

4. The fixing apparatus according to claim 1, wherein the plurality of halogen heaters comprises:

a first symmetric halogen heater in which an amount of heat generated from an end portion is larger than an amount of heat generated from a center portion;

a second symmetric halogen heater in which an amount of heat generated from a center portion is larger than an amount of heat generated from an end portion;

a third symmetric halogen heater in which an amount of heat is substantially uniform in a longitudinal direction; and an asymmetric halogen heater in which an amount of heat generated from an end portion is larger than an amount of heat generated from a center portion, and in which an amount of heat generated from an end portion on the one end side on which the driving-force transmission member is provided is larger than an amount of heat generated from an end portion on the other end side.

5. The fixing apparatus according to claim 4, wherein the number of asymmetric halogen heaters is smaller than the number of first symmetric halogen heaters.

6. The fixing apparatus according to claim 5, wherein the number of asymmetric halogen heaters is smaller than the number of second symmetric halogen heaters.

7. The fixing apparatus according to claim 1, wherein a peak value on an amount of heat generated from the one end side of the at least one asymmetric halogen heater on which the driving-force transmission member is provided is larger than a peak value on an amount of heat generated from the other end side, by a value equal to or higher than 15% and equal to or smaller than 60%.

* * * * *